US005238071A

United States Patent [19]

Simpson

[11] Patent Number: 5,238,071

[45] Date of Patent: Aug. 24, 1993

[54] OIL WELL FIRE SNUFFER

[76] Inventor: Harold G. Simpson, 2311 Fleetwood Dr., San Bruno, Calif. 94066

[21] Appl. No.: 774,200

[22] Filed: Oct. 10, 1991

[51] Int. Cl.[5] ..... A62C 3/06

[52] U.S. Cl. ..... 169/47; 169/49; 169/52; 169/69

[58] Field of Search ..... 169/69, 43, 47, 48, 169/49, 52

[56] References Cited

U.S. PATENT DOCUMENTS

| | | | |
|---|---|---|---|
| 1,520,288 | 12/1924 | Featherstone | 169/69 X |
| 1,830,061 | 11/1931 | Howe | 169/69 X |
| 3,730,278 | 5/1973 | Roy | 169/69 X |
| 3,815,682 | 6/1974 | Chiasson et al. | 169/69 X |
| 3,887,011 | 6/1975 | Dokes et al. | 169/69 |
| 3,973,631 | 8/1976 | Hefetz | 169/46 |
| 4,323,118 | 4/1982 | Bergmann | 169/69 X |
| 4,337,831 | 7/1982 | Thaxton | 169/69 |
| 4,433,733 | 2/1984 | Cunningham | 169/49 |
| 5,105,893 | 4/1992 | Barnak | 169/69 X |
| 5,146,995 | 9/1992 | Kim | 169/69 X |
| 5,158,138 | 10/1992 | DeCuir, Sr. | 169/69 X |

*Primary Examiner*—David M. Mitchell
*Assistant Examiner*—Andrew C. Pike

[57] ABSTRACT

A device for extinguishing oil well fires having an inverted conical steel chamber which is lifted by a crane and placed over the wellhead of a burning oil well. The chamber is dropped into place so that it embeds itself into the sand or soil around the wellhead. Numerous fire hoses supply water to the interior of the chamber to extinguish the fire. Gas exhaust valves vent the interior of the chamber so that the pressure of the steam created does not lift the chamber off of the fire. A remotely controlled damper plate at the top of the chamber can be closed to seal off the fire inside the chamber. The chamber is made in sections that can be dissassembled and nested together for ease in shipping or storage.

13 Claims, 5 Drawing Sheets 50
10
40
90
105
80
60
140
32
70
34
100
20
110

OIL WELL FIRE SNUFFER

FIELD OF THE INVENTION

The present invention relates to oil well fires, in particular to an apparatus for extinguishing such fires.

BACKGROUND OF THE INVENTION

Recently, extinguishing oil well fires has become a matter of urgency, as exemplified in Kuwait following the Gulf war. Several methods already in use in Kuwait have proved very slow; as a result, many oil well fires are burning several months after the process of extinguishing began.

One of these methods is to approach the oil well fire with a massive charge of explosives mounted on the end of a protruding arm; when ignited (by remote control) near the burning oil wellhead, the exploding charge is intended to blow the fire out. The principle used here is the same as that used when blowing a candle out, except that it is done on a massive scale. The problem with this method is that although the exploding charge may effectively blow the fire out, it carries the risk of unintentionally reigniting the explosive gasses which are present, and so keeping the fire going. Since it is a "hit and miss" idea, it is not reliable. Sometimes this method is tried several times before success is obtained. Sometimes the well is abandoned and left burning.

Another method is to tunnel underground until the supply pipe is reached, then drill into the pipe and inject fire retardant chemicals or low viscosity mud into the well pipe to reduce the oil flow and, consequently, the fire's magnitude. Subsequently, the explosive charge method can be reapplied. The problem with this method is the time required to do the tunneling, subsequent drilling, and mud injection.

B. H. Cunningham, in U.S. Pat. No. 4,433,733, dated Feb. 28, 1984, shows a framework of tubular material which is covered with flexible material such as asbestos on its sides and top. The tubular framework has inwardly facing holes which can be supplied with a fire retardant fluid, such as water.

The problem with this method is that the use of asbestos is no longer considered environmentally acceptable, and no other lightweight fire resistant material exists to replace it. Another problem is that the pressure of escaping oil from an oil wellhead is so intense that lightweight materials would be destroyed before the fire could be extinguished. Also, because of its light weight, it would be buoyed up by the escaping oil column and the ascending heat, making it difficult or impossible to maneuver the device into place over the fire.

D. G. Thaxton, in U.S. Pat. No. 4,337,831, dated Jul. 6, 1982 shows a fire extinguishing apparatus for oil wells in which a bell nipple is constructed in position around an oil well pipe as a preventive measure. The apparatus has a plurality of containers which house fire extinguishing material, and is connected by conduit means, so that if a fire ever occurs, it can be quickly extinguished by metering the material through valves into the bell nipple.

The problem with this type of fire extinguisher is that it must be built before any fire occurs in the oil wellhead. It is not practical to bring the apparatus to where a fire already exists, due to the extreme heat and engineering needed to put the mechanism together to make it work.

U. Hefetz, in U.S. Pat. No. 3,973,631, dated Aug. 10, 1976, shows a method and apparatus for extinguishing oil well fires in wells having an inner pipe and an outer pipe separated by an annular space. The method involves drilling into both inner and outer pipes and inserting spikes radially to close off the pipes. In addition, any protective piping used around the oil and gas supply pipes must be first removed before work can be started in closing off the supply pipes. The problem with this method is that it is not possible for workers to get within 50 yards of the burning oil well fire due to the high temperature of the burning oil, let alone work on the oil well pipes above ground level.

OBJECTS AND ADVANTAGES

Accordingly, several objects and advantages of the present invention are to provide a method of extinguishing an oil well fire with speed and effectiveness, and to provide a means to effectively isolate the burning oil from the surrounding supply of air. A further advantage is to provide a means to impinge the escaping column of burning oil with jets of water (or other fire retardant liquid) and to provide means to replace the air supply in and around the burning oil with volumes of steam.

Additional objects and advantages are to provide a means to seal off air from the burning oil well at ground level simultaneously to sealing off air from the upper levels of the burning oil column, and to provide an apparatus which can withstand the ravages of fire and heat long enough to extinguish a vertically burning oil well fire or one which burns laterally. Further objects and advantages are to provide means to accurately maneuver the apparatus into a satisfactory position over and around the oil well fire and at the same time to maintain its temperature at a sufficiently low level to prevent heat damage to the apparatus.

Still further objects and advantages are to provide means to ship the apparatus to another oil well fire quickly, or to dismantle the apparatus into a packageable size for long distance shipping and subsequent reassembly.

Further objects and advantages will become apparent from a consideration of the ensuing description and accompanying drawings.

DETAILED DESCRIPTION OF THE INVENTION

Figures 1, 2, 3, 4, 5, 6A:
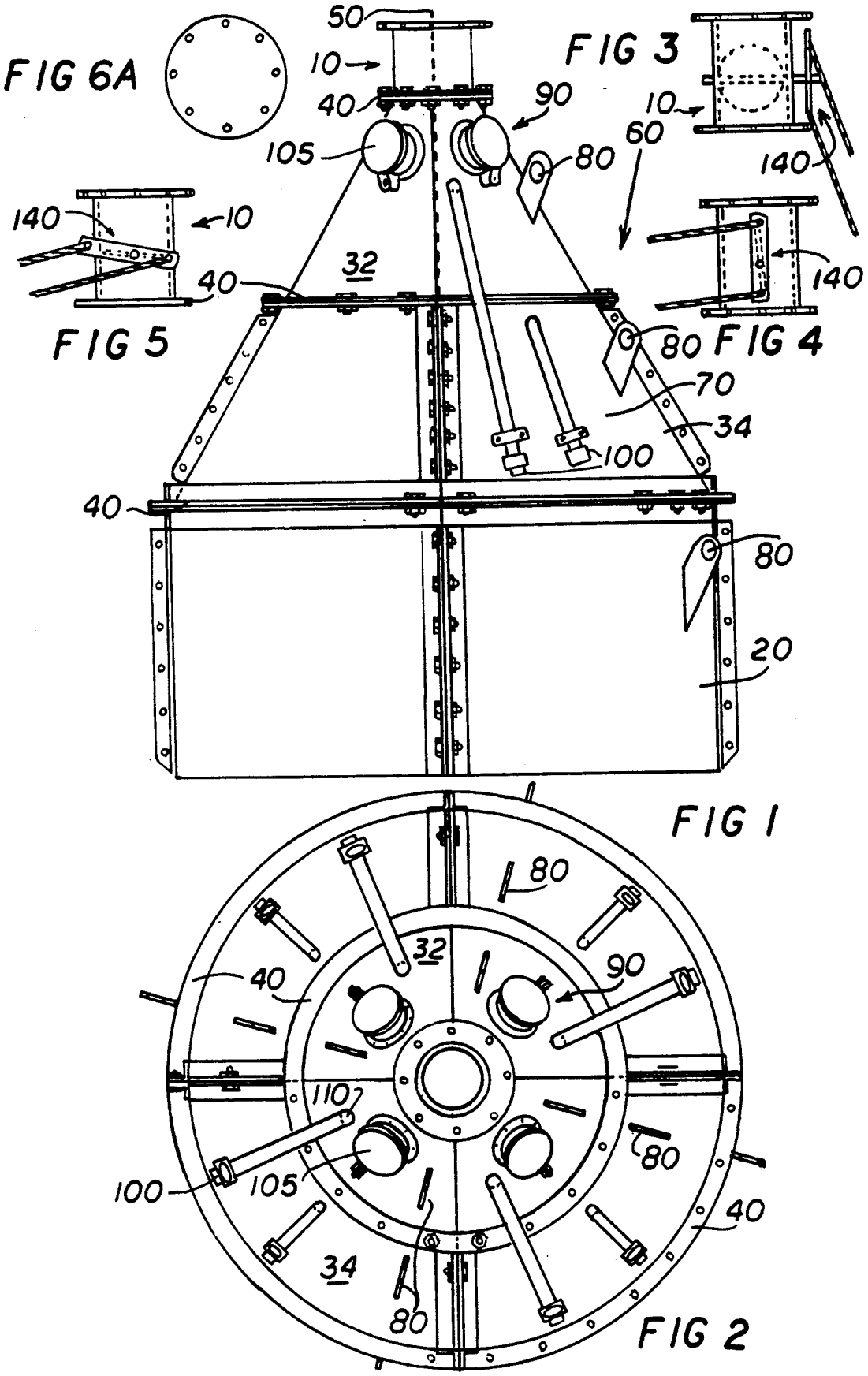
FIG. 1 is a side perspective view of the fire snuffer chamber of the invention.
FIG. 2 is a top perspective view of the chamber of FIG. 1.
FIG. 3 is a front perspective view of a damper used in conjunction with the chamber of FIG. 1.
FIG. 4 is a side perspective view of the damper of FIG. 3, shown in the open position.
FIG. 5 is a side perspective view of the damper shown in FIG. 3 in the closed position.
FIG. 6A is a top view of a cover plate for the top of FIG. 3 or FIG. 1.
Figure 7:
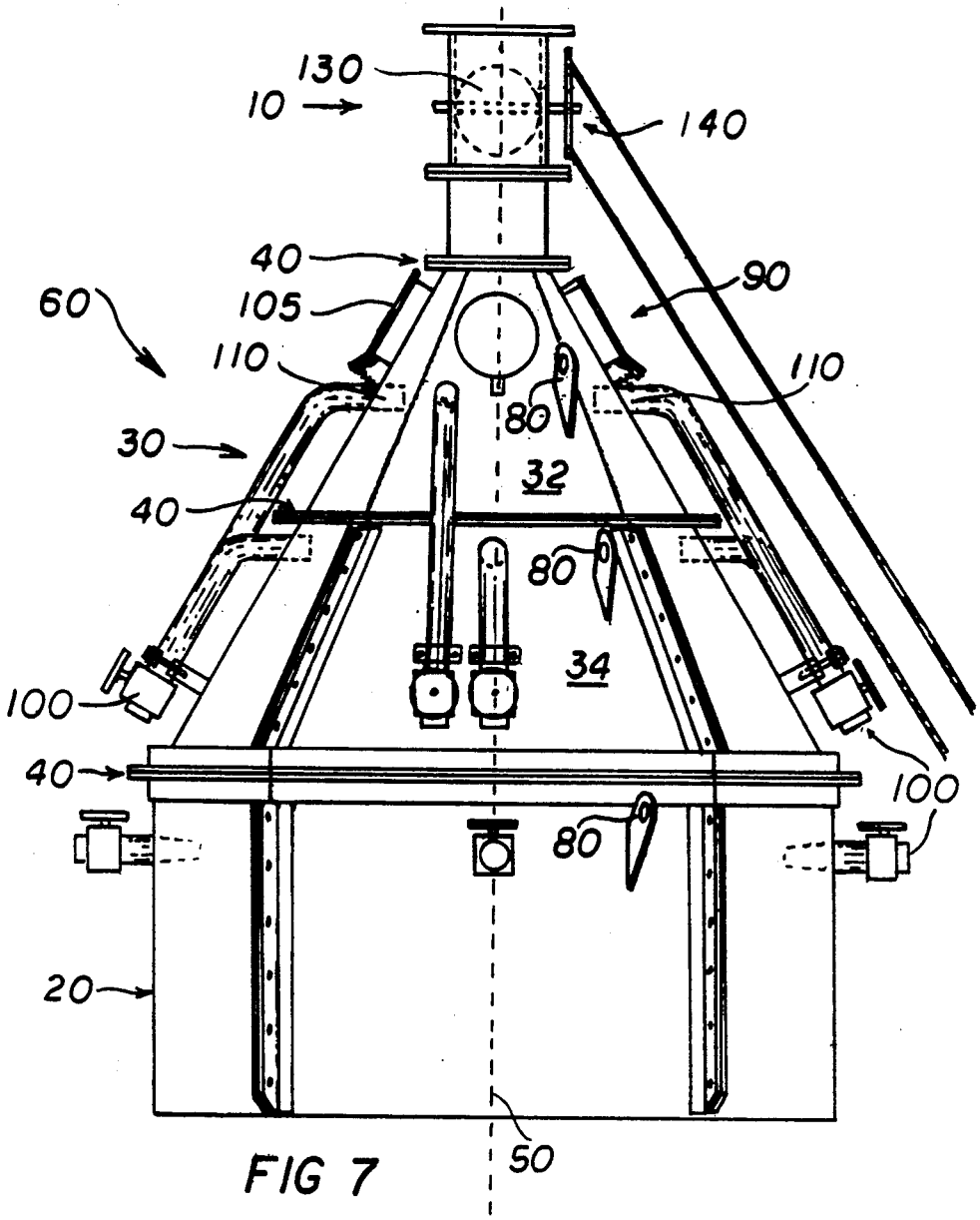
FIG. 7 is a side perspective view of the chamber of FIG. 1 with the damper of FIG. 4 attached.
Figure 9:
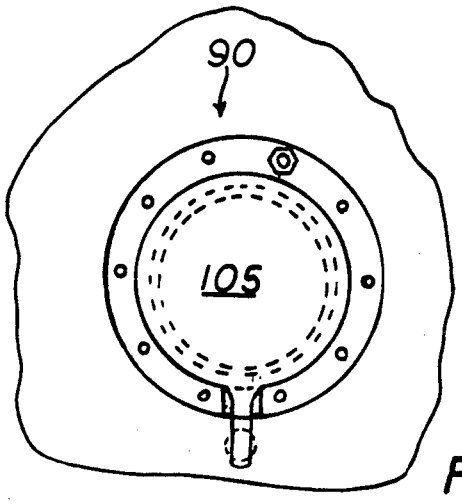
FIG. 9 is a top view of a gas exhaust valve of FIG. 8.
Figure 8:
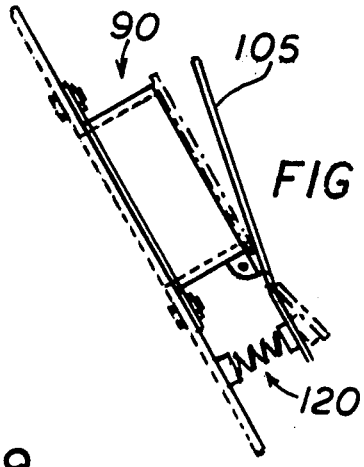
FIG. 8 is a side perspective view of a gas exhaust valve.

The preferred embodiment of the invention, as shown in FIGS. 1, 2 and 7, is an apparatus for extinguishing a fire constructed of a small diameter cylindrical top portion 10 and a large diameter cylindrical bottom portion 20, which are joined together by a truncated cone-shaped transition portion 30. The transition portion 30 has generally circular flanges 40 at each end for attaching to mating flanges 40 on the bottom portion 20 and the top portion 10. The bottom portion 20, transition portion 30 and top portion 10 are aligned along a vertical axis 50 and fixed together to form a chamber 60. This modular construction allows the chamber 60 to be disassembled for easier storage and transportation. Optionally, the transition portion 30 may be constructed of an upper transition section 32 and a lower transition section 34 mated together by flanges 40, which allows disassembly into even smaller parts. For ease of fabrication and assembly, each of the elements of the chamber 60 may be constructed of smaller elements. By way of example, the bottom portion 20, upper transition section 32, and lower transition section 34 in FIGS. 1, 2 and 7 are shown as being constructed in quadrants which can be fabricated separately and welded or bolted together.

On the exterior surface 70 of the chamber 60 are mounted a plurality of lifting eyes 80 which are arranged so that the chamber 60 can be lifted while maintaining the vertical orientation of its axis 50. Also mounted on the exterior surface 70 of the chamber 60 are water pipes 110 or other water conducting means that direct water into the interior of the chamber 60. Each water pipe 110 has a fitting 100 or other means to connect it with a water supply. The chamber 60 has at least one gas exhaust valve 90 so that excess gas pressure can be exhausted from the chamber 60. In the preferred embodiment, there are four such exhaust valves 90 mounted near the top of the upper transition section 32. Each exhaust valve 90 has a pivoted cover plate 105 which is held in a normally closed position by an urging means 120, such as a spring. When the pressure inside the chamber 60 exceeds atmospheric pressure by a specified amount, the cover plates 105 will open to relieve the excess pressure within the chamber 60.

As shown in FIG. 7, the top portion 10 of the chamber 60 may be extended to accommodate a rotatable damper plate 130. The damper plate 130 is rotatable from a fully open position to vent the chamber 60 to a fully closed position to prevent gases from escaping the chamber 60 through the top portion 10. The damper plate 130 can be operated by a rotation means 140 external to the top portion 10 of the chamber 60. The rotation means 140 may include a pair of cables that allow the damper plate 130 to be controlled remotely so that personnel will not have to move too close to the chamber while the oil fire is still burning.

The chamber 60 is preferably made of thick plates of steel (half an inch or more thick) to make it resistant to damage from the heat of the fire. In addition, the interior of the chamber may have a fire resistant lining 150 to prevent overheating of the chamber 60. The lining 150 may be made of asbestos, furnace cement or another fire resistant material. The lining 150 may be formed as solid sheets or the material may be applied to the interior of the chamber as a liquid slurry and allowed to dry in place.

Figure 6B:
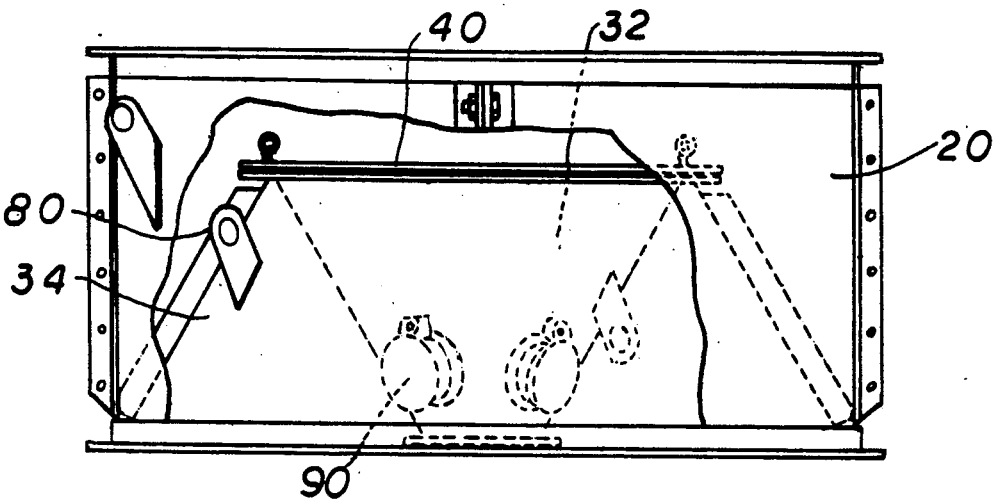
FIG. 6B is a sectioned side view of the three sections of the chamber nestled together for shipping.
Figure 6C:
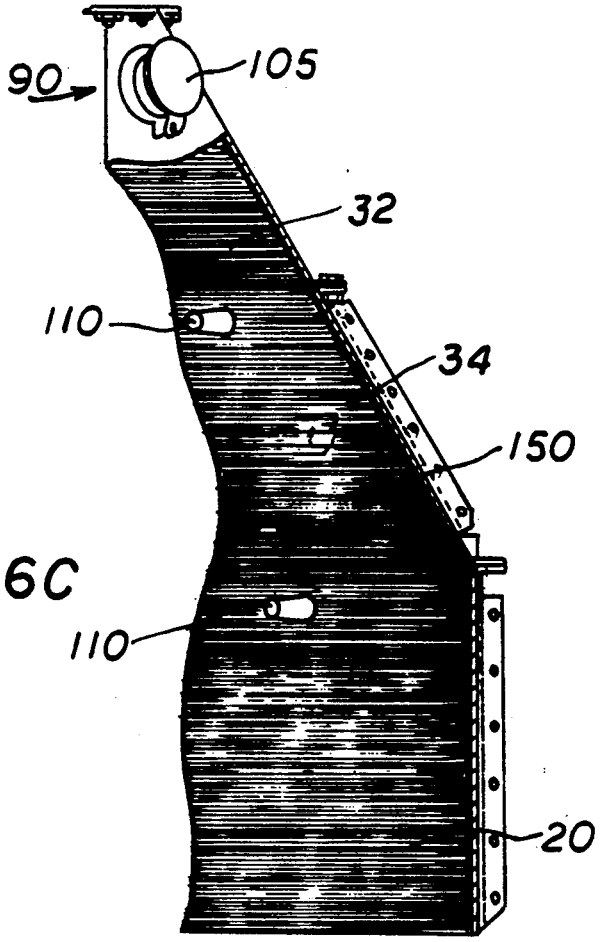
FIG. 6C is a sectioned side view of part of the chamber.

The chamber 60 may be disassembled for easy storage and transportation. The chamber 60 is designed so that the top portion 10, the upper transition section 32 and the lower transition section 34 nest inside the bottom portion 20 to make one compact unit for shipping and storage, as shown in FIG. 6*b*.

OPERATIONAL DESCRIPTION

Figure 10:
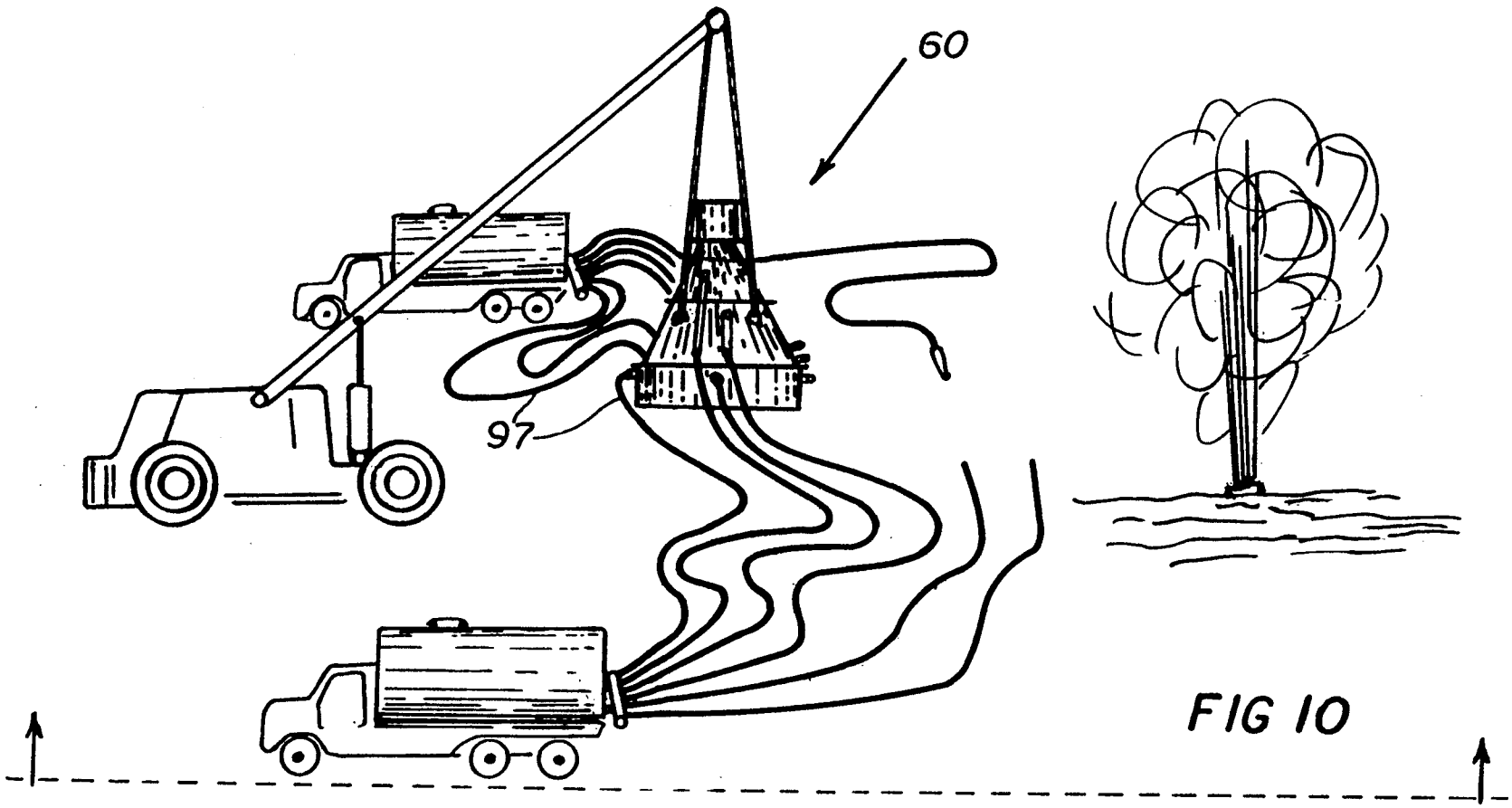
FIG. 10 is a scenic view of the layout of utilities in preparation for extinguishing an oil well fire.

When the invention is needed for extinguishing an oil well fire, the chamber 60 is shipped to the location of the fire and assembled on site. As shown in FIG. 10, the fittings 100 are connected by hoses to a water supply which may be one or more water tankers. The hoses on the side nearest the fire should not be attached yet so they will not be damaged when the chamber is lifted over the fire. Additional hoses may be used to spray water onto the exterior of the chamber 60 or directly onto the fire.

Figure 11:
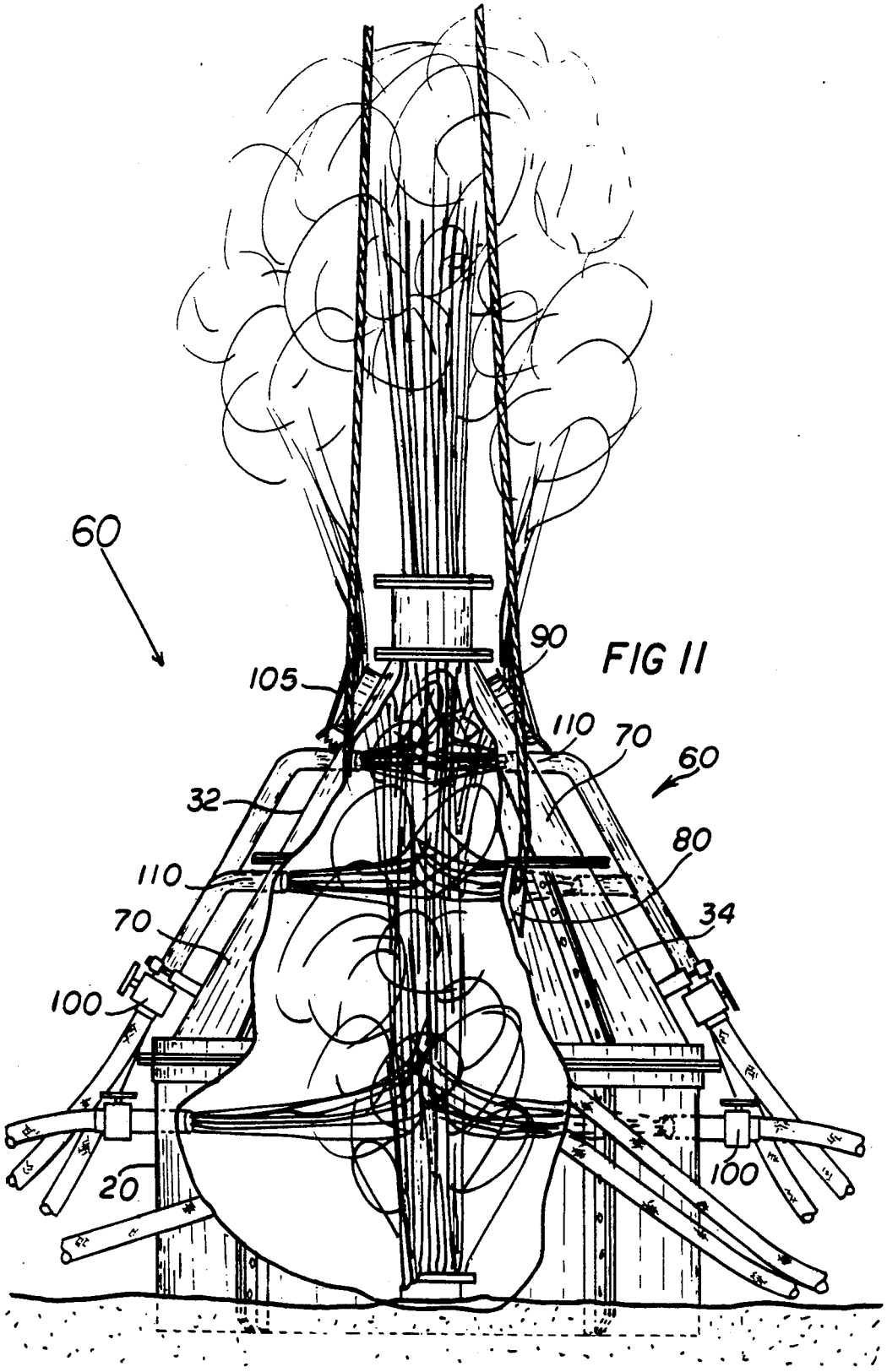
FIG. 11 is a sectioned view of the chamber in operating position while extinguishing an oil well fire.

A crane or hoist is attached to the chamber 60 by the lifting eyes 80. The crane lifts the chamber a few feet off the ground and moves it closer to the fire. When the chamber 60 is close to the fire the water flow into the chamber is turned on and the chamber 60 is positioned over the wellhead and lowered to within 12 to 18 inches of the ground. The chamber 60 is allowed to drop the last 12 to 18 inches so that the lower edge of the chamber will embed itself in the sand or soil, as shown in FIG. 11, which effectively seals off air entering the chamber at ground level. Once the chamber is in place over the wellhead, the remaining water hoses can be connected to the fittings 100 on the side of the chamber 60 which passed over the fire. The water pipes 110 direct jets of water onto the burning oil inside the chamber 60. Some of the water continues across to the opposite side of the chamber 60, cooling it down. Water falling on the ground puts out any pools of oil burning there, and, at the same time, it improves the airtight seal around the bottom of the chamber 60. Some of the water turns to steam which displaces the air inside the chamber 60, helping to extinguish the fire.

Excess pressure within the chamber 60 will cause the gas exhaust valves 90 to open. This venting is necessary so that the pressure inside the chamber 60 does not lift it off of the fire. The springs 120 will automatically close the cover plates 105 on the valves 90 as soon as the fire begins to cool and the water jets condense the steam within the chamber 60. The damper plate 130 can be closed to hasten the extinguishing of the fire.

SUMMARY, RAMIFICATIONS, AND SCOPE

Thus, the reader will see that my fire snuffer has many advantages over the prior art. When it is dropped over a burning oil well fire, pressure within the chamber increases, thus opening the flapper valves. Almost instantaneously, it cuts off the air supply around its base, while, at the same time, its nine water jets impinge against the escaping column of burning oil, spraying water onto the hot inside surface of the steel plate, thus creating massive amounts of steam which fill the chamber and mix with any remaining air within.

Continued injection of water within the chamber cools the hot chamber down and rapidly condenses the steam within the chamber to water, thus creating a reduction in pressure within the chamber which closes the flapper valves assisted by springs. Any escaping oil can be immediately stopped by closing the damper valve with the guy cables.

While the above description contains many specificities, the reader should not construe these as limitations on the scope of the invention, but merely as exemplifications of preferred embodiments thereof. Those skilled in the art will envision that many other variations are within its scope. For example, skilled artisans will readily be able to change the dimensions and shapes of the various embodiments, such as by making the chamber larger, or smaller, or a different shape, such as square, hexagon, octagon, oval, etc. Also, it could be made higher or lower, or with other materials, such as steel alloys, stainless steel, titanium or any other suitable material. The number of water jets could be increased or decreased, and fire retardant chemicals could be added to the water.

Accordingly, the reader is requested to determine the scope of the invention by the appended claims and their legal equivalents, and not by the examples which have been given.

I claim:

1. An apparatus for extinguishing a fire comprising:

a cylindrical top portion;

a cylindrical bottom portion having a larger diameter than that of the top portion; and a truncated cone-shaped transition portion having generally circular flanges at each end for mating with the bottom portion at one end and the top portion at the other end, the bottom, transition, and top portions being fixed together in vertical axial alignment defining a vertical axis to form a chamber, the chamber having an exterior surface on which is mounted at least one each of a lifting eye, a gas exhaust valve, a means for water hose attachment, and a means for conducting water into the chamber.

2. The apparatus of claim 1 further including at least two of the at least one lifting eye fixed to the exterior surface in opposed positions such that the chamber may be lifted while maintaining the vertical axis in a vertical orientation.

3. The apparatus of claim 1 wherein the at least one gas exhaust valve is fixed on the chamber on the transition portion adjacent to the top portion such that excess gas pressure within the chamber may be exhausted from the chamber through the at least one gas exhaust valve.

4. The apparatus of claim 3 wherein the at least one gas exhaust valve has a pivoted cover plate in a normally closed position, and an urging means for holding the cover plate in the closed position, against a larger than atmospheric pressure within the chamber.

5. The apparatus of claim 1 further including a rotatable damper plate mounted within the top portion, the damper plate having a range of motion extending between fully open and fully closed positions such that with the plate in the closed position gases within the chamber cannot pass upward through the top portion to escape.

6. The apparatus of claim 5 wherein the damper plate further includes a means for damper plate rotation, the rotation means being controllable from a remote location such that the damper plate may be positioned without personnel moving into close proximity of the chamber.

7. The apparatus of claim 6 further including a valve actuator attached to the damper plate, wherein the rotation means is a pair of cables extending from the actuator to the remote location.

8. The apparatus of claim 1 wherein at least one of the water conducting means is a pipe attached at one end to the hose attachment means and at another end to the chamber.

9. The apparatus of claim 1 further including a fire resistant lining attached within the chamber for protecting the chamber from heat degradation.

10. The apparatus of claim 9 wherein the lining is made of asbestos.

11. The apparatus of claim 9 wherein the lining is a dried slurry.

12. The apparatus of claim 1 wherein the transition portion comprises upper and lower sections such that the top portion, the upper transition section, and the lower transition section, when disassembled, will nestle within the cylindrical bottom portion whereby the apparatus is easily transported and stored as a compact unit.

13. A method for extinguishing a fire, comprising the steps:

providing a chamber having a cylindrical top portion, a cylindrical bottom portion, and a truncated cone-shaped transition portion having generally circular flanges at each end for mating with the bottom portion at one end and the top portion at the other end, the bottom, transition, and top portions being fixed together in vertical axial alignment to form a chamber, the chamber having an exterior surface on which is mounted at least one each of a lifting eye, a damper valve, a gas exhaust valve, a means for water hose attachment, and a means for conducting water into the chamber;

connecting at least one hose from a water source to the at least one means for water hose attachment;

directing water from said water source at the chamber and through the at least one means for conducting water;

positioning the chamber over the fire;

dropping the chamber to a ground surface; and closing the damper valve to eliminate combustion air.

* * * * *